United States Patent [19]

Kingston et al.

[11] Patent Number: 4,712,309

[45] Date of Patent: Dec. 15, 1987

[54] ADJUSTABLE TEMPLATE FOR POSITIONING TILE OF VARIOUS SIZES

[76] Inventors: Arthur G. Kingston, 3226 Orchard Dr., Palm Harbor, Fla. 33563; Carl R. DeLong, 1605 44th Ave. South, New Port Richey, Fla. 33552

[21] Appl. No.: 38,929

[22] Filed: Apr. 16, 1987

[51] Int. Cl.[4] ..... G01B 5/16

[52] U.S. Cl. ..... 33/527; 33/562; 33/DIG. 20

[58] Field of Search ..... 33/526, 527, 562, 613, 33/645, DIG. 20

[56] References Cited

U.S. PATENT DOCUMENTS

| | | | |
|---|---|---|---|
| 2,466,919 | 4/1949 | Sykes | 33/526 |
| 2,770,043 | 11/1956 | Kwiecinski | 33/DIG. 20 |
| 2,930,135 | 3/1960 | Rodtz, Sr. | 33/DIG. 20 |
| 3,199,205 | 8/1965 | Halde et al. | 33/526 |
| 3,254,417 | 6/1966 | Carmichael, Sr. | 33/526 |
| 3,775,856 | 12/1973 | Schmidt | 33/DIG. 20 |

*Primary Examiner*—Richard R. Stearns
*Attorney, Agent, or Firm*—Walter J. Monacelli

[57] ABSTRACT

The template described herein comprises one that is adjustable to be suitable for use with tile of various sizes. A first series of parallel longitudinal bars are dovetailed with a second series of lateral bars positioned perpendicularly to the bars in the first series. The positioning of the bars can be adjusted to give the desired individual spacing for each tile and the bars can be fixed to each other to give sufficient rigidity for use as a template and sufficient rigidity to allow lifting of the template.

20 Claims, 11 Drawing Figures

ADJUSTABLE TEMPLATE FOR POSITIONING TILE OF VARIOUS SIZES

BACKGROUND OF THE INVENTION

1. Field of the Invention

This invention relates to an adjustable template designed for the positioning of tile. More specifically it relates to a template which may be adjusted for the positioning of tile of various sizes. Still more specifically it relates to a template which can be adjusted to accommodate inaccuracies in the actual dimensions of the tile.

2. State of the Prior Art

Fixed templates are presently known which are used for the positioning of tile, for example, for use in laying a floor. However, such templates are fixed in their construction so that they can be used only for the one size for which they are designed. There is no way to adjust the size of the tile openings to accommodate tile of other sizes or to accommodate variations in the size of the tile from that intended.

For example, U.S. Pat. No. 2,466,919 shows a fixed tile setting template used for laying successive rows of tile, one row at a time. Even this is useful for only one fixed size of tile and is not adjustable to accommodate tile of different sizes. Nor is it useful for laying more than one row of tile at the same time.

There are various sizes of floor tile available, for example, in the following standard sizes in inches: 4×4; 4×6; 4×8; 4×10; 4×12; 6×6; 6×8; 6×10; 6×12; 8×8; 8×10; 8×12; 10×10; 10×12; 12×12, etc. In addition to these standard sizes some manufacturers produce tile ⅛ inch or more larger or smaller than the stated dimensions. This requires considerable adjustability in a template to be used for positioning tile.

OBJECTIVES

It is an object of this invention to design a template that can be adjusted to accommodate various sizes of tile.

It is also an object of this invention to design one template which can accommodate various sizes of tile.

It is also an object of this invention to design an adjustable template which can accommodate inaccuracies in the dimensions of a tile from those actually ordered.

It is also an object of this invention to design an adjustable template which can be easily dissembled for storage or transportation.

It is also an object of this invention to design an adjustable template which can be easily lifted from its position once the tile have been positioned.

Other objects of this invention will become obvious upon reading the following disclosures of this invention.

SUMMARY OF THE INVENTION

In accordance with the present invention a template has been designed which accomplishes the above objectives by an adjustable template comprising a series of bars having a width equal to the grout lines which are to be left between the tile and having a number of grooves running across the width of the bars. In the assembled template one series of bars are positioned parallel to each other with the grooves therein facing upward, and a second series of bars are positioned parallel to each other and at right angles to the bars in the first series, and with the grooves in the second series of bars facing downward and positioned so that the grooves in one series of bars fit into the grooves of the other series of bars.

In one series of bars the first grooves, for example, the first groove at the extreme left end of the bars may be the exact dimension to accommodate the insertion of a crossbar. Then as the grooves progress toward the right and width of each succeeding groove is increased to accommodate additive variations in tile size. These variations in groove width are made to accommodate the positioning of the crossbars in accordance with the variations in size. Thus where a manufacturer supplies 8"×8" tile with an actual ⅛ inch oversize or undersize in each dimension, the positioning of the longitudinal and crossbars must be adjusted in accordance with these variations. Moreover the adjustment is complicated by the fact that while the adjustment in the first row of bars is ⅛", the adjustment increases by ⅛" for each successive row so that, for example, the fourth row of tile will require an adjustment of ½". These adjustments must be made both longitudinally and laterally.

The grooves in both the longitudinal and in the lateral or cross bars are complementary so that the sum of the depth of a groove in a longitudinal bar and of that in a lateral bar will equal the depth of the bars. The longitudinal and lateral bars advantageously have the same depth dimension so that the bottom edges of both series of bars will be in the same plane which is desirable so that the assembled template will lie flat on the supporting bed of mortar for the tile. The upper surfaces of the two series of bars are also advantageously in the same plane but in this case this latter is not a critical requirement. Advantageously it is desirable to have the same depth in each series of bars and to have the grooves in each case with depths equal to one-half of the depth of the bars. In such cases all the bottoms of the bars in both series will lie in the same plane and all the tops of the bars in both series will lie in the same plane.

In view of the increasing width of the grooves as they progress from one end of the bars to the other end, it is desirable to have a means for securing the positions of the longitudinal and lateral bars and thereby provide some rigidity to the assembly. One means for providing security and improved rigidity is to have perpendicular brackets with a slot opening in each of the two side pieces of the bracket so that threaded bolts may be screwed into threaded openings in the areas of the bars adjacent to the brackets so that tightening of the bolts will tighten the position of the brackets against the bars and thereby fix the position of the bars with respect to each other. These brackets are advantageously positioned on the portion of each bar which extends beyond the first and last grooves in the bar. These "angle" brackets are thus advantageously positioned around the four sides of the assembled template. Such an arrangement generally provides sufficient rigidity to enable an operator to lift the template off the mortar bed after the tiles have been laid in position. If desired to aid in such lifting, handles may be fastened to the tops of two bars, near the center of the assembled template.

If additional rigidity is desired brackets of various designs may be added at the tops of a number of junctions of longitudinal lateral bars. Such a bracket may be one having slotted cross which fits down and embraces tightly short portions of both the longitudinal and lateral bars on both sides of the junction. Or such a bracket may be one that fits onto and embraces a short section of one bar and a short section of the adjoining bar.

SPECIFIC EMBODIMENTS OF THE INVENTION

The description of this invention is facilitated by reference to the drawings.

Figure 1:
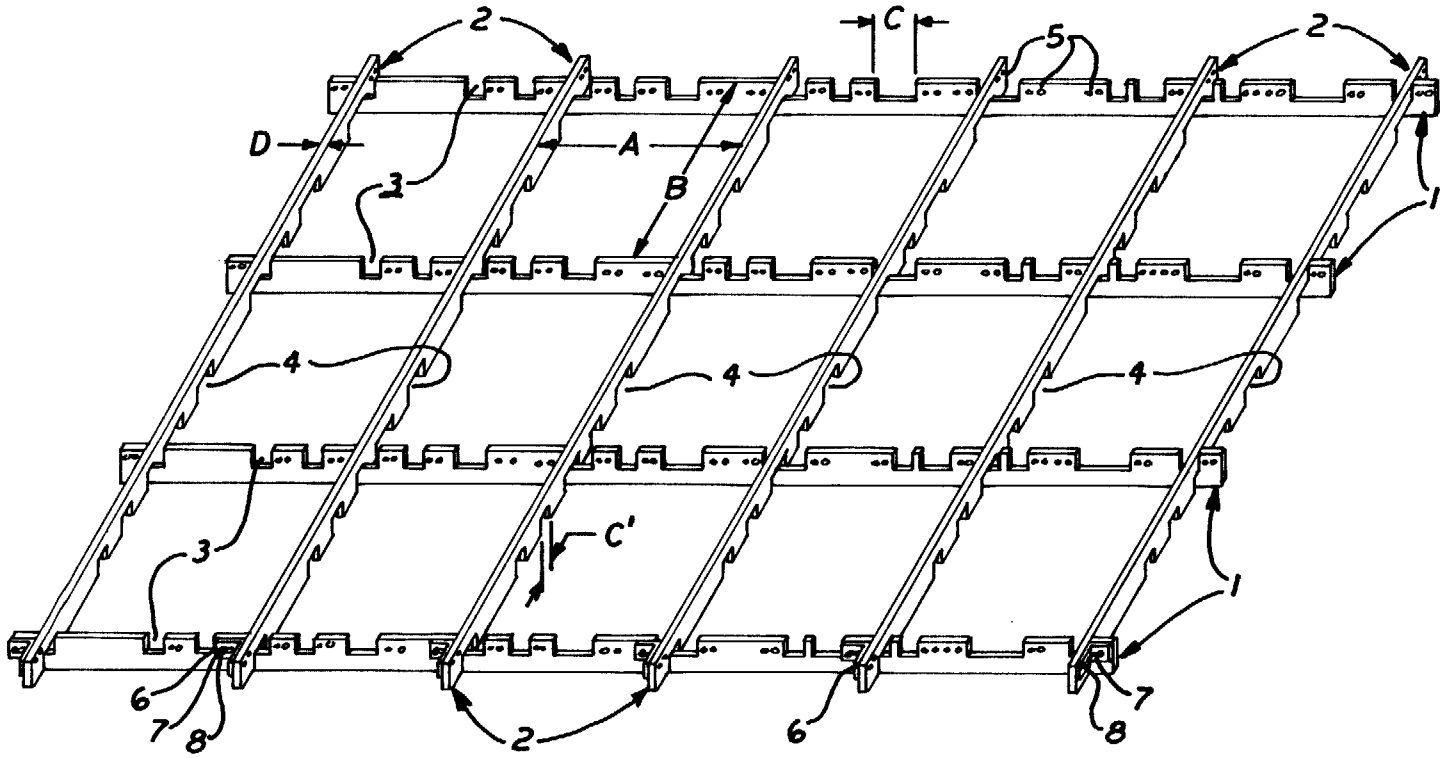
FIG. 1 is a perspective view of an assembled adjustable template of this invention having four longitudinal bars and six lateral or cross bars.
Figure 2:
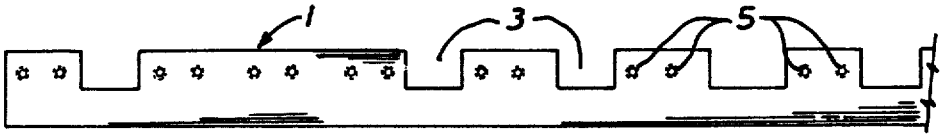
FIGS. 2–5 show four consecutive quarter sections of a longitudinal bar a preferred modification of this invention.
Figure 3:
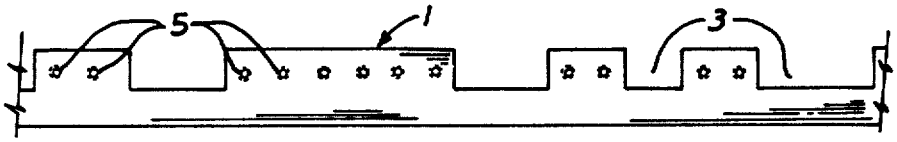
Figure 4:
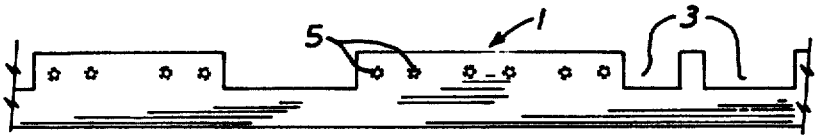
Figure 5:
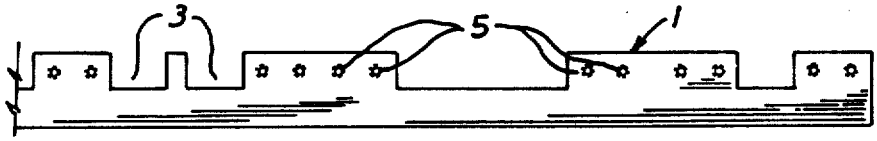

FIG. 1 shows longitudinal bars 1 and lateral or cross bars 2. The longitudinal bars have grooves 3 cut therein which face upward. The lateral or cross bars have grooves 4 cut therein which face downward. The grooves in the lateral bars are positioned to fit over the grooves in the longitudinal bars and have a depth appropriate to have the lower surfaces of the lateral bars in the same plane as the lower surfaces of the longitudinal bars which is the plane which will coincide with the top surface of the mortar bed on which the template will be rested while the tile are being laid. Holes 5 are drilled into the longitudinal bars and also into the lateral bars and threaded so that threaded bolts or screws may be threaded therein. Right angle brackets 6 which have slots 7 are positioned over these openings so that threaded bolts or screws 8 may be placed therein and tightened to hold the brackets in place against the longitudinal and lateral bars and thereby hold the bars firmly in position with respect to each other.

The adjacent longitudinal bars are spaced a distance B from each other to correspond to the length of the tile and the adjacent lateral bars are spaced a distance A from each other to correspond to the width of the tile. Thus the tile can be laid into the individual areas bound by the respective longitudinal and lateral bars. The width C of grooves 3 are appropriate as described above to accommodate the adjustments in positioning the lateral bars. Likewise the width C' of grooves 4 in the lateral bars are appropriate to accommodate the adjustments in positioning the longitudinal bars.

The width of the longitudinal and lateral bars corresponds to the grout line between tile which in most cases is ¼". FIG. 1 is not according to scale and the position and size of the grooves are not truly represented since these may be varied considerably. These are shown more accurately in the subsequent FIGS. 3–8.

FIG. 1 is shown to give a general idea of how the longitudinal and lateral bars are assembled. A more accurate description of the appropriate dimensions are given in FIGS. 2–5. Since it would be difficult to show the dimensions in full length bars, these are broken down into sections FIGS. 2–5 showing four consecutive quarter sections of a preferred modification of a longitudinal bar having an overall length of 43¾ inches, a thickness of ¼ inch and a depth of 1 inch. The grooves are cut ½ inch deep in each case.

Figure 6:
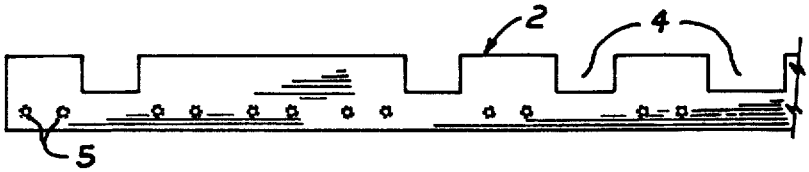
FIGS. 6–8 show three consecutive one-third sections of a lateral bar a preferred modification of this invention.
Figure 7:
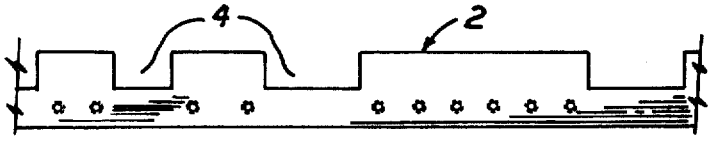
Figure 8:
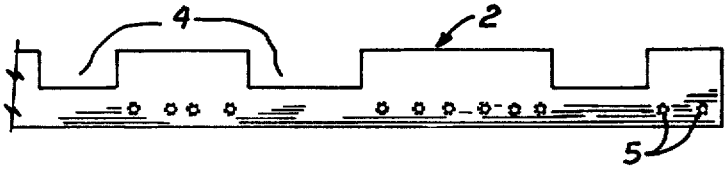

FIGS. 6–8 show three consecutive one-third sections of a preferred modification of a lateral bar having an overall length of 27¾ inches, a thickness of ¼ inch and a depth of 1 inch. Again the grooves are cut ½ inch deep but cut from the bottom instead of the top of the bar.

Figure 9:
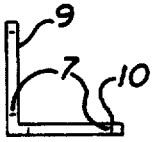
FIG. 9 is a side elevational view of a right angle bracket used to fasten adjacent longitudinal and lateral bars.
Figure 10:
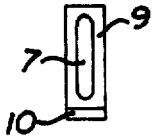
FIG. 10 is a rear elevational view of the bracket of FIG. 9.

The bracket shown in FIGS. 9 and 10 has upright arm 9 and horizontal arm 10 which are at right angle to each other. Each of the arms has a slot 7, preferably about ½ inch in length.

Figure 11:
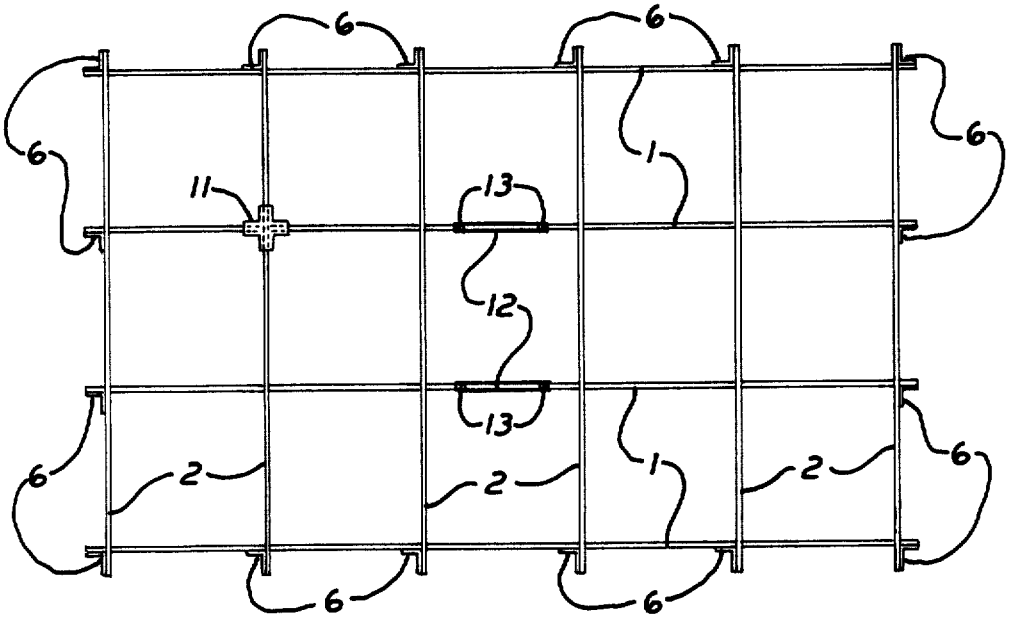
FIG. 11 is a top plan view of the assembled template showing the attachment of the brackets of FIGS. 9 and 10 to the longitudinal and lateral bars.

FIG. 11 shows a top plan view of an assembled template with four longitudinal bars 1 and six lateral or cross bars 2. A set of 16 brackets 6 is shown to hold the bars attached to each other for the positioning of a particular size of tile. An optional bracket 11 is also shown which fits down on the top of a pair of adjoining longitudinal and lateral bars. The tops of the bars are pressed snugly into two grooves in the bracket which together form a cross. Handles 12 are fastened by screws 13 to the top of two bars which have their grooves facing upward. Such handles may be positioned also on bars for which the grooves face downward provided there is sufficient rigidity between the crossed bars.

In a preferred modification the specific dimensions for the spacing and width of the grooves in the first series of bars are given. For FIG. 2 the distance of the first groove from the left end of the bar is 1"; the width of the first groove is ¾"; the second groove is spaced 3½ inches from the first groove and the second groove has a width of ¾"; the spacing of the third groove from the second groove is 1½ inches and the width of the third groove is ¾"; the spacing of the fourth groove from the third groove is 1¼" inches and width of the fourth groove is 1 inch; the spacing of the fifth groove from the fourth groove is 1 inch and the width of the fifth groove is ¾". The spacing between the fifth groove in FIG. 2 and the sixth groove (the first to the left in FIG. 3) is 1¼ inches and the width of the sixth groove is 1¼ inches; the spacing between the seventh groove and the sixth groove is 3" and the width of the seventh groove is 1¼"; the spacing between the eighth groove and the seventh groove is 1" and the width of the eighth groove is ¾"; the spacing between the ninth groove and the eighth groove is 1" and the width of the ninth groove is 1½"; the spacing between the tenth groove (the first groove shown in FIG. 4) and the ninth groove (in FIG. 3) is 2½" and the width of the tenth groove is 1¾"; the spacing between the eleventh groove and the tenth groove is 3½" and the width of the eleventh groove is ¾"; the spacing between the twelfth groove and the eleventh groove is 5/16" and the width of the twelfth groove is 1 3/16"; the spacing between the thirteenth groove (the 1st groove in FIG. 5) and the twelfth groove (in FIG. 4) is 1" and the width of the thirteenth groove is ¾"; the spacing between the fourteenth groove and the thirteenth groove is ¼" and the width of the fourteenth groove is ¾"; the spacing between the fifteenth groove and the fourteenth groove is 2" and the width of the fifteenth groove is 2¼"; the spacing between the sixteenth groove and the fifteenth groove is 2¼" and the width of the sixteenth groove is ¾"; the spacing of the sixteenth groove from the right end of the bar is 1".

In each case the threaded openings in each pair of openings are spaced ½" from each other and each opening is positioned ¼" below the top edge of the longitudinal bar. In the 2" spacing between the fourteenth and fifteenth grooves there are two pairs of openings with the spacing between the two openings in each pair being ½" from each other. In other cases where there is a greater distance between grooves, there may be an even greater number of openings. This arrangement is to accommodate the greater distances between grooves. Regardless of the number of openings it is generally desirable to have approxiately ½" between adjacent openings. The spacings and groove widths described above are to accommodate tile in which the tile length may be selected from dimensions of 4, 6, 8, 10, or 12 inches, etc.

In this preferred modification the specific dimensions for the spacing and width of grooves in second series of bars (or lateral bars) as shown in FIGS. 6–8 are given as follows. In FIG. 6, the distance of the first groove from the left end of the bar is 1" and the width of the first groove is ¾"; the spacing between the second groove and the first groove is 3½ inches and the width of the second groove is ¾"; the spacing between the third groove and the second groove is 1¼" and the width of the third groove is ¾"; the spacing between the fourth groove and the third groove is 1¼" and the width of the fourth groove is 1"; the spacing between the fifth groove and the fourth groove is 1" and the width of the fifth groove (the first groove shown in FIG. 6) is ¾"; the spacing between the sixth groove the fifth groove is 1¼" and the width of the sixth groove is 1¼"; the spacing between the seventh groove and the sixth groove is 3" and the width of the seventh groove is 1¼"; the spacing between the eighth groove and the seventh groove is 1" and the width of the eighth groove is ¾"; the spacing between the ninth groove and the eighth grove is 1 inch and the width of the ninth groove is 1½"; the spacing between the tenth groove and the ninth groove is 2½" and the width of the tenth groove is 1¼ inches; and the spacing between the tenth groove and the right end of the bar is 1 inch. Accordingly tile widths may be selected from dimensions of 4, 6, 8, 10 or 12 inches, etc.

In each case for FIGS. 6–8, the threaded openings in the areas between grooves even where there are three or more openings the space between adjacent openings is advantageously about ½". As shown in FIGS. 6–8, each opening is positioned ¼" above the bottom edge of the bar. The bars of FIGS. 6–8 are inverted when positioned as the lateral or cross bars in the assembled versions of FIGS. 1 and 11. Upon inversion of the bars of FIGS. 6–8, the openings in the the lateral bars will be at the same level as the openings in the longitudinal bars so that one of the slots in a bracket will embrace one or two openings in the lateral bars and the other slot will embrace one or two openings in the longitudinal bars.

The arrangement of the openings shown in FIGS. 2–8 are nessecary only for the first and last bars in each series of longitudinal and lateral bars. While these may also be used for the intermediate bars in each case, the intermediate bars may have only the openings used for fastening the brackets at the ends of the bars As previously indicated the widths of the grooves are sufficient to accommodate the adjustments in positioning of the bars running perpendicular to the bar in which the groove is positioned. The farther a groove is from the first positioned crossbar the wider the next groove or grooves should be to accommodate the additive variations required for each added crossbar. The fastening of the crossbar in the required position is effected by the brackets at the ends of each bar. This is also accommodated by the length of the slot opening which allows for variations in the exact position at which the threaded bolt or screw is tightened to hold the two adjacent or overlapping bars firmly together. The width of each slot opening is great enough to allow the threaded portion of the bolt to pass through to the threaded opening and small enough to prevent the head of the bolt from passing through.

The bars described herein are preferably made of aluminum but may also be made of plastic or other metals which have sufficient strength and can be cut to form the grooves therein.

Where reference is made in the claims to "approximately the end of each bar" it is intended to include not only the end of the bar but also an area within several inches from the end of the bar.

Moreover while brackets as shown in the drawings are preferred, it is also contemplated, particularly where the template is to be used in a floor area adjacent to a wall that the bracket may be non-angular and may comprise a straight plate having openings therein which would permit bolting to the end of a bar which is flush with the side of the adjacent or adjoining crossbar. Furthermore this plate may be embedded in a recess of appropriate dimensions so that the plate will be flush with the exterior surface of the bar and will not extend beyond the surface of the bar.

Underneath each arm of the brackets, there may be two threaded openings spaced from each other and positioned so that one or both may be under the slot when the bracket is moved to various positions. In this way the variations in the position of the bracket may be given greater latitude.

While specfic dimensions have been given above for the spacing between grooves and for the width of grooves it is understood that these can be modified substantially in accordance with the invention described herein.

It is also contemplated that vertical pins may be positoned in the bottoms of the bars and spaced from each other so that, in the event the bed of mortar on which the tile are to be laid is too soft to support the template, these pins will penetrate the bed of mortar and rest on the solid flooring beneath the mortar. Obviously the protruding length of the pins will correspond to the thickness of the bed of mortar.

While certain features of this invention have been described in detail with respect to various embodiments thereof, it will of course be apparent that other modifications can be made within the spirit and scope of this invention and it is not intended to limit the invention to the exact details shown except insofar as they are defined in the following claims.

The invention claimed is:

1. An adjustable template designed for the positioning of tile comprising (a) a first series of parallel bars spaced from each other, each bar having similar dimensions respectively in length, width and depth and having a plurality of grooves cut therein facing downward or upward and having a width for each groove determined by the amount of adjustment required; (b) a second series of parallel bars spaced from each other and perpendicularly to the bars in said first series, each bar in said second series having similar dimensions respectively in length, width and depth and having a plurality of grooves cut therein facing upward or downward and complementary to the grooves in said first series of bars, the combined depth of a groove in the first series with a complementary groove in the second series being equal to the depth of the bars having the greater depth; and (c) a fastening means for securing approximately the end of each bar of each series to a bar in the other series; the grooves in the respective bars being of appropriate depth to have the respective bottoms of the bars in both series all in the same plane.

2. The template of claim 1 in which the width of each bar in both said series correspond in dimension to the desired width of grout lines between the tile to be laid.

3. The template of claim 2 in which the bars in both series of bars have the same depth dimension.

4. The template of claim 3 in which each groove has a depth equal to half the depth of the bar.

5. The template of claim 4 in which the grooves in said first series each faces upward and the grooves in said second series each faces downward.

6. The template of claim 5 in which said fastening means comprises a bracket having two arms therein, each arm perpendicular to the other, and each having a slot opening therein, said slot openings each being capable of receiving and holding therein a bolt screwed into a threaded opening in an adjacent area of one of said bars.

7. The template of claim 6 in which each slot has an appropriate length to allow variations in positioning of said threaded openings in said bar.

8. The template of claim 2 in which said fastening means comprises a bracket having two arms therein, each arm perpendicular to the other, and each having a slot opening therein, said slot openings each being capable of receiving and holding therein a bolt screwed into a threaded opening in an adjacent area of one of said bars.

9. The template of claim 8 in which each slot has an appropriate length to allow variations in positioning of said threaded openings in said bar.

10. The template of claim 1 in which the grooves in said first series each faces upward and the grooves in said second series each faces downward.

11. The template of claim 10 in which said fastening means comprises a bracket having two arms therein, each arm perpendicular to the other, and each having a slot opening therein, said slot openings each being capable of receiving and holding therein a bolt screwed into a threaded opening in an adjacent area of one of said bars.

12. The template of claim 11 in which each slot has an appropriate length to allow variations in positioning of said threaded openings in said bar.

13. The template of claim 2 in which the positioning and width of each groove is appropriate to give the positioning and adjustment of the bar to be placed perpendicularly therein.

14. The template of claim 4 in which the positioning and width of each groove is appropriate to give the positioning and adjustment of the bar to be placed perpendicularly therein.

15. The template of claim 6 in which the positioning and width of each groove is appropriate to give the positioning and adjustment of the bar to be placed perpendicularly therein.

16. The template of claim 7 in which the positioning and width of each groove is appropriate to give the positioning and adjustment of the bar to be placed perpendicularly therein.

17. The template of claim 10 in which the positioning and width of each groove is appropriate to give the positioning and adjustment of the bar to be placed perpendicularly therein.

18. The template of claim 1 in which a handle means is attached to the top of one or more bars to facilitate the lifting of said template.

19. The template of claim 9 in which each bar to which a bracket is to be attached has two threaded openings over which one of said slots may be positioned.

20. The template of claim 11 in which each bar to which a bracket is to be attached has two threaded openings over which one of said slots may be positioned.

* * * * *

UNITED STATES PATENT AND TRADEMARK OFFICE

CERTIFICATE OF CORRECTION

PATENT NO. : 4,712,309

DATED : Dec. 15, 1987

INVENTOR(S) : Arthur G. Kingston and Carl R. DeLong

It is certified that error appears in the above-identified patent and that said Letters Patent is hereby corrected as shown below:

Col. 2, line 7, delete "and" and substitute therefor "the".

Signed and Sealed this

Twenty-eighth Day of June, 1988

*Attest:*

*Attesting Officer*

DONALD J. QUIGG

*Commissioner of Patents and Trademarks*